United States Patent [19]

Abrams

[11] 4,408,356

[45] Oct. 11, 1983

[54] VENTILATED RAIN GARMENT

[76] Inventor: Simon Abrams, 100 Taft St., Hazleton, Pa. 18201

[21] Appl. No.: 330,173

[22] Filed: Dec. 14, 1981

[51] Int. Cl.[3] ..... A41D 3/04

[52] U.S. Cl. ..... 2/87; 2/93

[58] Field of Search ..... 2/87, 84, 93, 108, 85

[56] References Cited

U.S. PATENT DOCUMENTS 1,368,835 2/1921 Place ..... 2/87
1,562,767 11/1925 Hess ..... 2/87
2,259,560 10/1941 Glidden ..... 2/87
2,771,661 11/1956 Foster ..... 2/87
3,086,215 4/1963 DiPaola ..... 2/87

*Primary Examiner*—Doris L. Troutman
*Attorney, Agent, or Firm*—D. Paul Weaver

[57] ABSTRACT

A rain coat or jacket includes a lining of foraminous material to which is attached exteriorly in shingled relationship a plurality of horizontal sections of fluid impermeable material such as coated fabric. The lower edges of the shingled sections are tacked to resist being turned up by the wind.

1 Claim, 5 Drawing Figures

VENTILATED RAIN GARMENT

BACKGROUND OF THE INVENTION

The present invention relates to a rain garment which provides adequate ventilation to promote the comfort of the wearer of the garment while resisting penetration by rain in a very effective manner. The garment is lightweight, economical to manufacture, attractive in appearance and comfortable.

A feature of the invention is that the rain garment may be styled in various ways to form a short jacket or a full length coat. Its sleeves may be lined or unlined. It may have a hood storable in a pocket provided in the collar of the garment and it may be equipped with any preferred type of closure means, such as a slide fastener.

Other features and advantages of the invention will become apparent to those skilled in the art during the course of the following detailed description.

DETAILED DESCRIPTION

Figure 1:
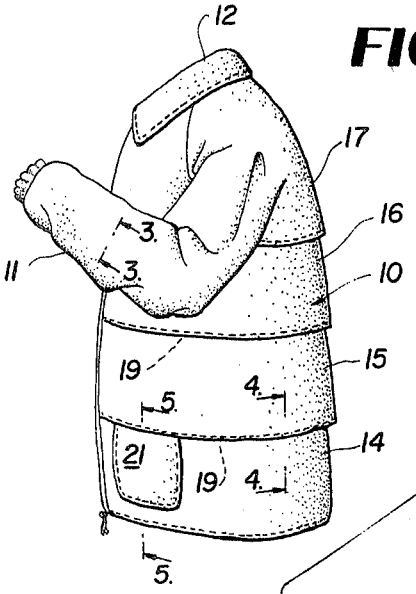
FIG. 1 is a side elevation of a ventilated rain garment according to the invention.
Figure 2:
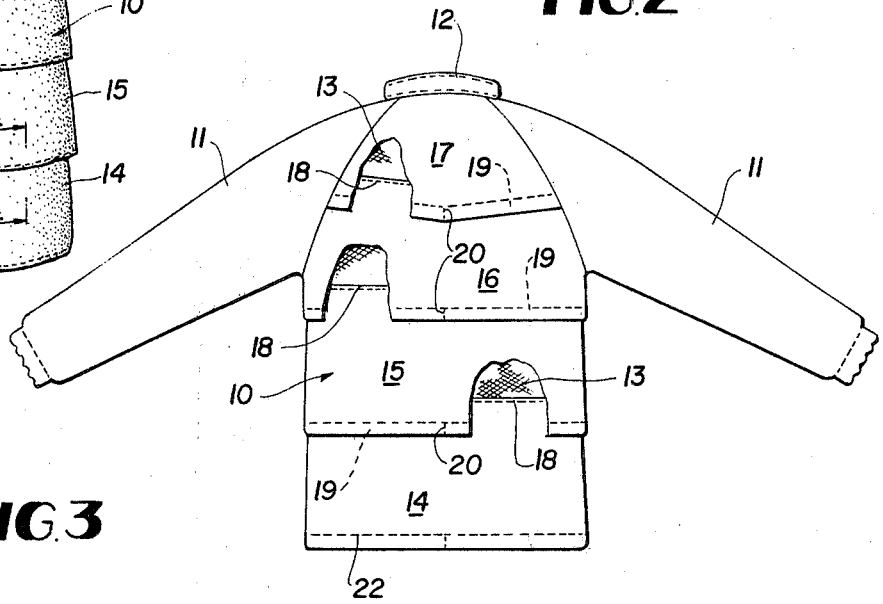
FIG. 2 is a rear elevation of the garment, partly broken away.
Figure 3:
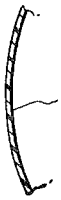
FIG. 3 is an enlarged fragmentary section through a sleeve taken on line 3—3 of FIG. 1.

Referring to the drawings in detail wherein like numerals designate like parts, a rain garment in the form of a jacket is illustrated, but it should be understood that the invention can be embodied equally well in a full length coat. The overall styling of the garment can be varied as found desirable and many of its constructional manufacturing details can be varied as well as the materials from which the garment is made without departing from the invention.

In the illustrated embodiment, the rain garment comprises a jacket body portion 10, attached sleeve 11, and a collar 12 which may contain a pocket, not shown, for the storage and concealment of a hood in accordance with known practice. The sleeves may be lined or unlined. In the present embodiment, they are unlined.

The body portion 10 includes a lining 13 consisting of lightweight but sturdy foraminous material, such as nylon mesh or equivalent material. Preferably, the lining is continuous from the top to the bottom of the body portion 10. It may be of one piece construction or may include a central large section covering the entire back of the garment and attached side sections extending forwardly to the front edges of the garment which may be closed by a slide fastener or other known closure means.

Attached to the exterior of the mesh lining 13 in accordance with the main feature of the invention is a plurality of horizontal parallel sections or strips 14,, 15, 16 and 17 in shingled relationship, said sections or strips being formed of fluid impermeable sheet material, such as coated fabric, rubber or plastics material. The vertical widths of the shingled sections of the garment may be varied but preferably the strips are about 8" wide in the vertical direction for an adult-size garment.

Figure 4:
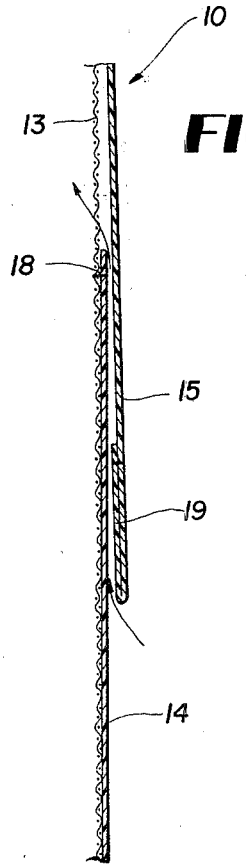
FIG. 4 is an enlarged fragmentary vertical section through the body of the garment taken on line 4—4 of FIG. 1.

The top edge of each section 14, 15, 16 and 17 is attached to the mesh lining 13 by a horizontal line of stitching 18. In lieu of stitching, heat sealing techniques may be employed depending upon the nature of the materials from which the garment is manufactured. The lower raw edge of each shingled section is inwardly turned up and hemmed as shown at 19 in FIG. 4. The lower edge of each shingled section is free of attachment with the underlying section except for tacking stitches 20 or equivalent means at the rear center of each section to prevent the wind from turning up the section.

Figure 5:
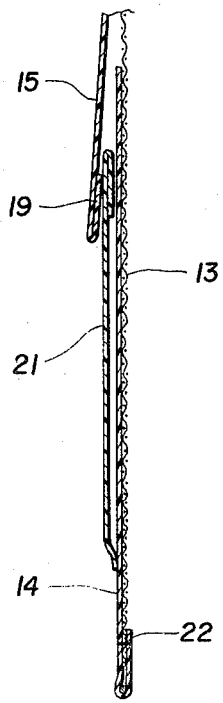
FIG. 5 is a similar section through a pocket taken on line 5—5 of FIG. 1.

The overlap distance between adjacent shingled sections in the embodiment shown is from 2"-3" and the overlap distance may be varied. Also, the number of shingled outer sections in the body portion of the garment may be varied. Another feature of the invention shown particularly in FIG. 5 is an arrangement whereby the lower edge portion of one shingled section, namely the section 15 in the illustrated embodiment, forms a closure flap for an open top pocket 21 provided on the exterior of the lower section 14. The lower edge portion of section 15 laps the top portion of the pocket 21, as shown, to form a closure.

While the lowest section 14 is shown stitched at 22 to the foraminous lining 13, FIG. 5, if preferred, the lower edge of the section 14 can be left free of attachment to the lining.

Essentially, therefore, the invention provides a rain garment whose outer shell at least on the body portion thereof is made up of plural shingled horizontal sections attached at their top edges only to a foraminous lining in the body portion, the lower edges of the shingled sections being tacked at local points only to the underlying sections to preclude the wind blowing the lower edges upwardly. The garment effectively resists penetration by rain while providing good ventilation between the shingled sections and through the lining, as shown by the directional arrows in FIG. 4.

For convenience of illustration and because the essence of the invention is not concerned with conventional manufacturing details, certain of these details such as the garment side seams where the front and back panels of the body portion are joined have been omitted from the drawings and description. As already stated, manufacturing and styling details may be varied.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A ventilated rain garment including a body portion, the body portion comprising a lightweight foraminous textile lining, an outer shell for the body portion comprising a plurality of relatively wide parallel horizontal sections of moisture-impermeable flexible sheet material disposed in shingled relationship on the exterior of the lining, said shingled sections being attached to the lining adjacent to the top edges of the sections by continuous horizontal lines of stitching through the sections and lining, the bottom horizontal edges of the shingled sections being substantially freely disposed one relative to another and relative to the lining, short tacking stitches at the rear center of the body portion only attaching the lower free edge portion of each shingled section to the top portion of the adjacent underlying shingled section therebeneath, whereby the shingled sections cannot be elevated at the rear of the garment by the force of wind or the like, and the lower edges of the shingled sections being folded inwardly and upwardly to produce concealed hems extending horizontally on the body portion and being secured by additional continuous horizontal lines of stitching.

* * * * *